United States Patent [19]

Harada

[11] 4,147,143

[45] Apr. 3, 1979

[54] ENGINE ACCELERATION DETECTION APPARATUS

[75] Inventor: Setsuo Harada, Hiroshima, Japan

[73] Assignee: Toyo Kogyo Co., Ltd., Aki, Japan

[21] Appl. No.: 833,704

[22] Filed: Sep. 15, 1977

[30] Foreign Application Priority Data

| | | | |
|---|---|---|---|
| Sep. 20, 1976 | [JP] | Japan | 51-113461 |
| Sep. 20, 1976 | [JP] | Japan | 51-113462 |
| Nov. 10, 1976 | [JP] | Japan | 51-151304[U] |

[51] Int. Cl.[2] ..... F02M 25/06

[52] U.S. Cl. ..... 123/119 A; 123/117 A

[58] Field of Search ..... 123/119 A, 117 A

[56] References Cited

U.S. PATENT DOCUMENTS

| | | | |
|---|---|---|---|
| 3,800,764 | 9/1972 | Goto et al. | 123/119 A |
| 3,835,827 | 9/1974 | Wolgemuth | 123/119 A |
| 3,920,041 | 11/1975 | Gropp | 123/117 A |
| 3,930,475 | 1/1976 | Lewis et al. | 123/119 A |
| 3,978,831 | 9/1976 | Yoshikawa | 123/117 A |
| 3,978,832 | 9/1976 | Walker | 123/117 A |
| 3,992,878 | 11/1976 | Moorman | 123/119 A |
| 3,996,905 | 12/1976 | Dawson | 123/119 A |
| 4,041,915 | 8/1977 | Konishi | 123/119 A |
| 4,056,083 | 11/1977 | Wakita | 123/119 A |
| 4,085,715 | 4/1978 | Otaka | 123/119 A |

*Primary Examiner*—Wendell E. Burns

*Attorney, Agent, or Firm*—Wenderoth, Lind & Ponack

[57] ABSTRACT

Engine acceleration detection apparatus comprising a diaphragm unit with a first chamber connected directly to a point downstream of a throttle valve in a carburetor, a second chamber connected to the same point through a delay element, a diaphragm which is provided between the first and second chambers and is displaced and causes displacement of an actuation rod element to actuate regulation means for adjustment of exhaust gas recirculation or other factors relating to engine operation when pressure increases downstream of the throttle valve, and atmosphere connection means which renders the diaphragm unit inoperative by connecting the second chamber thereof to the atmosphere in certain operating conditions, such as acceleration from high speed.

11 Claims, 6 Drawing Figures

ENGINE ACCELERATION DETECTION APPARATUS

The present invention relates to an apparatus for detection of acceleration of an automotive vehicle engine. More particularly the invention relates to engine acceleration detection apparatus which produces signals serving as control signals for adjustment of engine operating conditions, and which may be rendered inoperative during particular types of acceleration when such adjustment is undesirable.

It is known to provide apparatus for detection of acceleration of an automotive vehicle engine and modifying certain factors of engine operating conditions during acceleration of the engine. An example of such means is that disclosed in U.S. Pat. No. 3,930,475, according to which a diaphragm unit including a diaphragm whose position is determined by degree of vacuum downstream of a throttle valve in a carburetor automatically opens an exhaust gas take-off line to cause exhaust gas to be recirculated during acceleration of an engine. When an automobile accelerates from normal cruising speed, and in most other operating conditions, such recirculation is advantageous, as it contributes to suppression of emission of nitrogen oxides, for example. However, for certain types of acceleration, which occur less frequently, this recirculation of exhaust gas is undesirable. For example, on certain occasions it may be required to accelerate when the vehicle and engine are already running at high speed, and at such times, since large output is required, recirculation of exhaust gas is disadvantageous. For similar reasons, exhuast gas recirculation is undesirable if it is required to accelerate when the throttle valve of the carburetor is at or close to the fully open position, this again being a type of acceleration which is uncommon, but which is sometimes required. Also, during acceleration of a vehicle while the engine is cold, recirculation of exhaust gas adversely affects engine operation, but offers little advantage with respect to suppression of pollutants, since there is in any case little emission of nitrogen oxides in such operating conditions. Also, in particular ambient conditions, recirculation of exhaust gas may be undesirable even during normal acceleration, i.e., acceleration of a vehicle from a standard speed. This applies, for example, when air entering a carburetor is below a certain temperature, since in this case recirculation of exhaust gas, which has a comparatively high moisture content, is liable to result in freezing in the carburetor.

It is accordingly a principal object of the present invention to provide a vehicle engine acceleration apparatus which has improved versatility, and during normal acceleration automatically causes modification of factors relating engine operation, but is rendered inoperative during acceleration in special conditions in which modification of said factors may be disadvantageous.

It is a further object of the invention to provide a vehicle acceleration apparatus which, although having a simple construction is able to modify engine operating conditions as required for a plurality of types of acceleration conditions.

In accomplishing these and other objects, there is provided, according to the present invention, an automotive vehicle acceleration detection apparatus comprising a diaphragm unit comprising a diaphragm which divides the diaphragm unit into a first chamber, which connects directly to a point of the intake horn of a vehicle engine which is downstream of a throttle valve, and a second chamber, which connects to the same point of the intake horn through a delay means. When pressure in the first chamber of the diaphragm unit becomes a certain amount higher than pressure in the second chamber of the unit, as happens during opening of the throttle valve for acceleration of the vehicle, the diaphragm is displaced and actuates means for control of recirculated exhaust gas, and/or other means, for example an ignition control means, secondary air control means, or fuel supply control means, in a manner required during acceleration of the engine. The diaphragm may be connected directly to these control means or may cause production of electrical control signals which are supplied thereto. During certain types of acceleration, however, for which actuation of the control means is not required, the second chamber of the diaphragm unit is connected to the atmosphere, whereby there is no production of a difference in pressure between the first and second chambers of the diaphragm unit liable to cause the diaphragm to actuate the above-mentioned control means.

A better understanding of the present invention may be had from the following full description of several preferred embodiments thereof when read in reference to the attached drawings, in which like numbers refer to like parts, and FIG. 1 is a schematic drawing showing principal elements of an automotive vehicle acceleration detection apparatus according to the invention;

FIGS. 2(*a*) and 2(*b*) are schematic views showing the apparatuses of the invention employed in association with exhaust gas recirculation systems;

Figure 1:
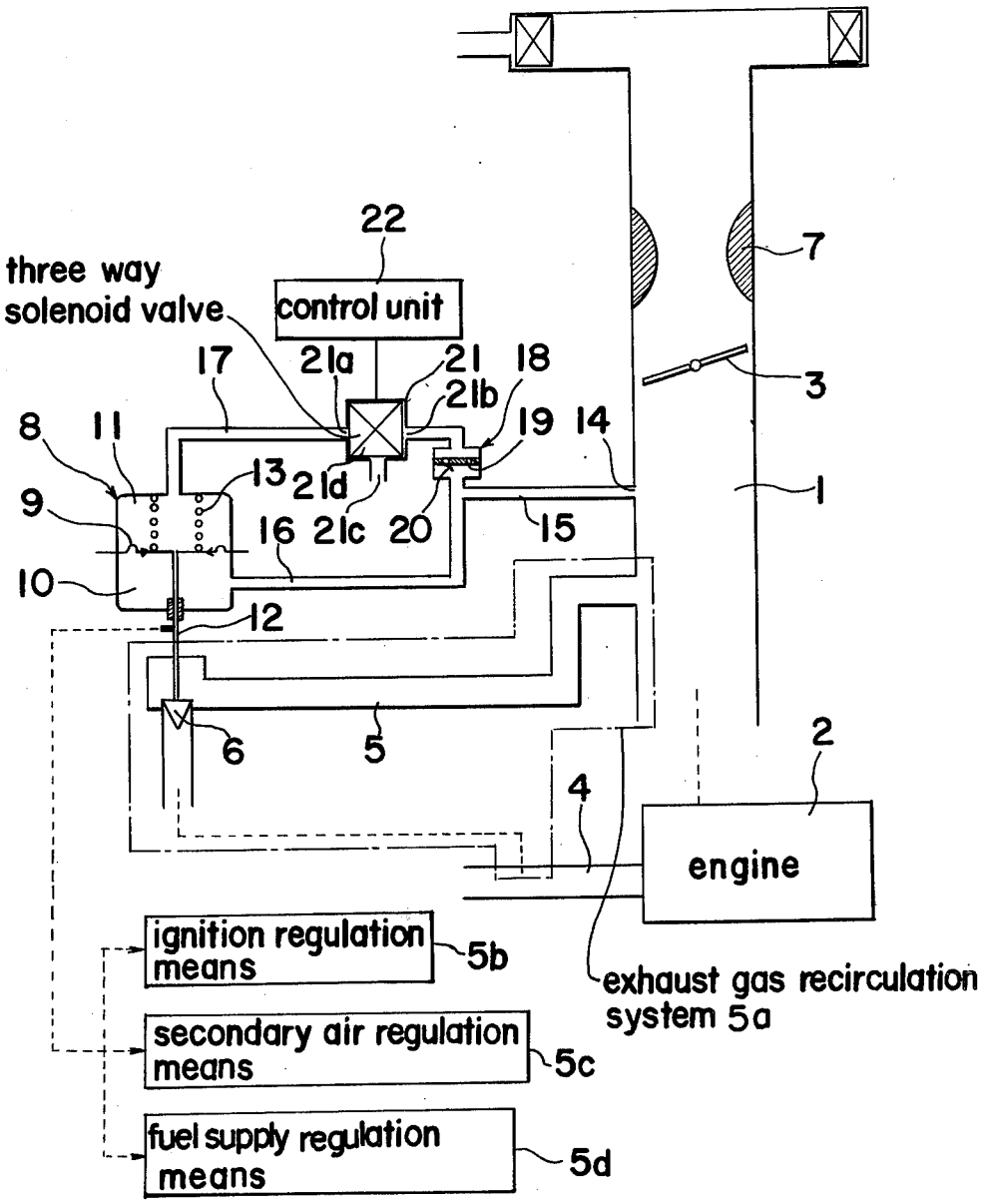

Referring to FIG. 1, an air-fuel mixture may be supplied to an engine 2 by a carburetor which is provided schematically in an intake horn or an intake passage 1 and includes, in addition to other conventionally known elements not shown, a venturi section 7 and a throttle valve 3, which in terms of intake fluid flow, indicated by the arrow in the drawing, into and through the intake horn 1, is downstream of the venturi section 7. In a wall portion of intake horn 1 downstream of the throttle valve 3 there is defined a pressure detection port 14 which constitutes one end of a pressure transmission line 15 leading to a first branch transmission line 16 and a second branch transmission line 17. The first branch transmission line 16 leads direct to a first chamber 10 of a diaphragm unit 8. The second branch transmission line 17 leads through a delay element 18 and an atmosphere connection means 21, which are described in greater detail below, to a second chamber 11 of the diaphragm unit 8. The diaphragm unit 8 is divided into the first chamber 10 and second chamber 11 by a movable diaphragm 9, which is fixedly connected to an actuation rod 12 which is moved together with the diaphragm 9 and extends through the main housing wall of diaphragm unit 8 to the exterior of diaphragm unit 8. In the second chamber 11 there is provided a spring means 13 which is connected to the diaphragm 9 and exerts a constant force urging the diaphragm 9 towards the first chamber 10 side of diaphragm unit 8, downwards as seen in the drawing, and which, when unopposed, holds the diaphragm 9 in a normal position, which, in turn, holds actuation rod 12 also in a normal position.

Flow of fluid through the delay element 18 provided on the second branch transmission line 17 can only take place through a restriction orifice 19 and a check valve 20 which is provided in parallel to the restriction orifice 19, opens when pressure in the second chamber 11 of diaphragm unit 8 is higher than pressure at the pressure detection port 14, and closes when pressure is higher at the port 14 than in the second chamber 11. The combined flow area through the restriction orifice 19 and the check valve 20 in the fully opened position is approximately equal to that through unimpeded portions of the second branch transmission line 17.

With this apparatus, when the engine 2 is running at a constant speed, pressure in the portion of intake horn 1 adjacent to the pressure detection port 14 remains generally constant, and so there is more or less equal pressure in the first chamber 10 and second chamber 11 of diaphragm unit 8 and the spring means 13 is unopposed to cause the actuation rod 12 to be moved to a normal position. Pressure in chambers 10 and 11 at this time is generally equal to that in the pressure transmission line 15 connecting to the port 14. If the throttle valve 3 is throttled down, to cause deceleration of the vehicle driven by the engine 2, increased vacuum is produced at the port 14 and in the pressure transmission line 15. In this case, there is rapid equalization of pressure in the line 15 and in the first chamber 10 of diaphragm unit 8, since fluid may pass directly through the pressure transmission line 15 and first branch transmission line 16, and, as pressure is temporarily higher in the diaphragm unit second chamber 11, the check valve 20 opens, resulting in rapid equalization of pressure in the second chamber 11 and line 15. There is therefore no movement of the diaphragm 9 and the actuation rod 12 is maintained in the normal position.

If, however, the throttle valve 3 is opened, to cause acceleration of the vehicle, pressure rises at the location of the port 14 and becomes higher than pressure in chambers 10 and 11 of the diaphragm unit 8. This difference of pressure causes closure of the check valve 20. Pressure in the first chamber 10 rises rapidly to become equal to that present in the pressure transmission line 15, but since flow of fluid from the pressure transmission line 15 to the second chamber 11 is limited to flow through restriction orifice 19 it takes a certain time for equalization of pressure between the second chamber 11 and pressure transmission line 15 to be achieved.

During this time, therefore, pressure in the diaphragm unit second chamber 11 is lower than in the first chamber 10, and for the portion of this time during which the difference of the values of pressure in chambers 10 and 11 exceeds a certain set value, the higher pressure in the first chamber 10 causes the diaphragm 9 to move counter to the force of spring means 13, and the actuation rod 12 to be moved from its normal position.

The time required for pressure in the second chamber 11 and pressure in the pressure transmission line 15 to be equalized when the latter is initially higher is determined principally by size of the restriction orifice 19, which is selected in reference to known average duration of acceleration in the vehicle in which the acceleration detection means is provided in a known manner.

When the actuation rod 12 is moved from its normal position it causes actuation of a regulation means whose connection to the actuation rod 12 is indicated schematically by the dot and chain line portion and dashed line portions of FIG. 1, and may be a direct mechanical connection or a connection through known electrical transfer means, and which adjust or change factors relating to the engine operation in a manner required by or suitable for acceleration of the engine. Examples of such regulation means include an exhaust gas recirculation system **5*a*, which causes recirculation of exhaust gas, in response to the actuation of rod 12, an ignition regulation means 5*b*, a secondary air regulation means 5*c*, and a fuel supply regulation means 5*d***, respectively provided for altering ignition rate, air supply, and fuel supply during acceleration.

Although shown in FIG. 1 as being located at a position in which it is downstream of the throttle valve 3 for all positions of the valve 3, the pressure detection port 14 may be located in a position in which it is downstream of the valve 3 only as long as the valve 3 is not opened more than a certain amount. If the pressure detection port 14 is thus located, movement of the throttle valve 3 is sensed indirectly, and the diaphragm unit 8 functions in the above-described manner, while the valve 3 is opened from a position on which the valve 3 is not opened more than the certain amount, but when the valve 3 is opened from a position on which the valve 3 is opened more than the certain amount, change of pressure downstream of the valve 3 is not detected and the diaphragm unit 8 therefore does not function during movement of the valve 3 at greater degrees of opening. In other words, the diaphragm unit 8 functions to actuate the control means **5*a***, etc., if there is acceleration from low to medium loads, but not when there is acceleration from high load.

Still in FIG. 1, the above mentioned atmosphere connection unit 21 provided on the second branch transmission line 17 suitably comprises a housing defining a diaphragm unit connection port **21*a*, which connects to the portion of line 17 which leads to the second chamber 11 of diaphragm unit 8, a delay element connection port 21*b*, which connects to the portion of line 17 which leads to the delay element 18, and an atmosphere connection port 21*c*, which connects to the atmosphere via a suitable duct means, and accommodating a three-way solenoid valve 21*d*, which is actuable to selectively open and close the ports 21*a*, 21*b* and 21*c*, and is normally in an unactuated position in which it maintains the atmosphere connection port 21*c* closed and the ports 21*a* and 21*b* open. In other words, when the three-way solenoid valve is unactuated the atmosphere connection unit 21 in effect simply constitutes a portion of second branch transmission passage 17, and diaphragm unit 8** functions in the manner described above.

In conditions in which, regardless of whether the engine 2 is being accelerated or not, it is required not to actuate the regulation means **5*a*, etc., the three-way solenoid valve 21*d* of the atmosphere connection unit 21 is actuated in response to signals from a control unit 22, which causes the solenoid valve 21*d* to open atmosphere port 21*c* while leaving at least diaphragm connection port 21*a* open, whereby pressure in the second chamber 11 of diaphragm unit 8 is made generally equal to atmospheric pressure. In these conditions, even if pressure in the second chamber 11 becomes greater than in the first chamber 10, because of lowering of pressure at the port 14 and in the first chamber 10 of diaphragm unit 8, the difference of pressure in chambers 10 and 11 simply assists the spring means 13, and so control the rod 12 continues to be held in the normal position, and if there is a rise of pressure in the first chamber 10 because of opening of the throttle valve 3 for acceleration, the rise is insufficient to cause the diaphragm 9 to be moved counter to the force of spring means 13, and so the actuation rod 12** still remains held in the normal position. In other words, the invention offers the advantage of improved versatility of an acceleration detection means, which may be selectively rendered operative or inoperative in accordance with engine operating conditions.

Figure 2:
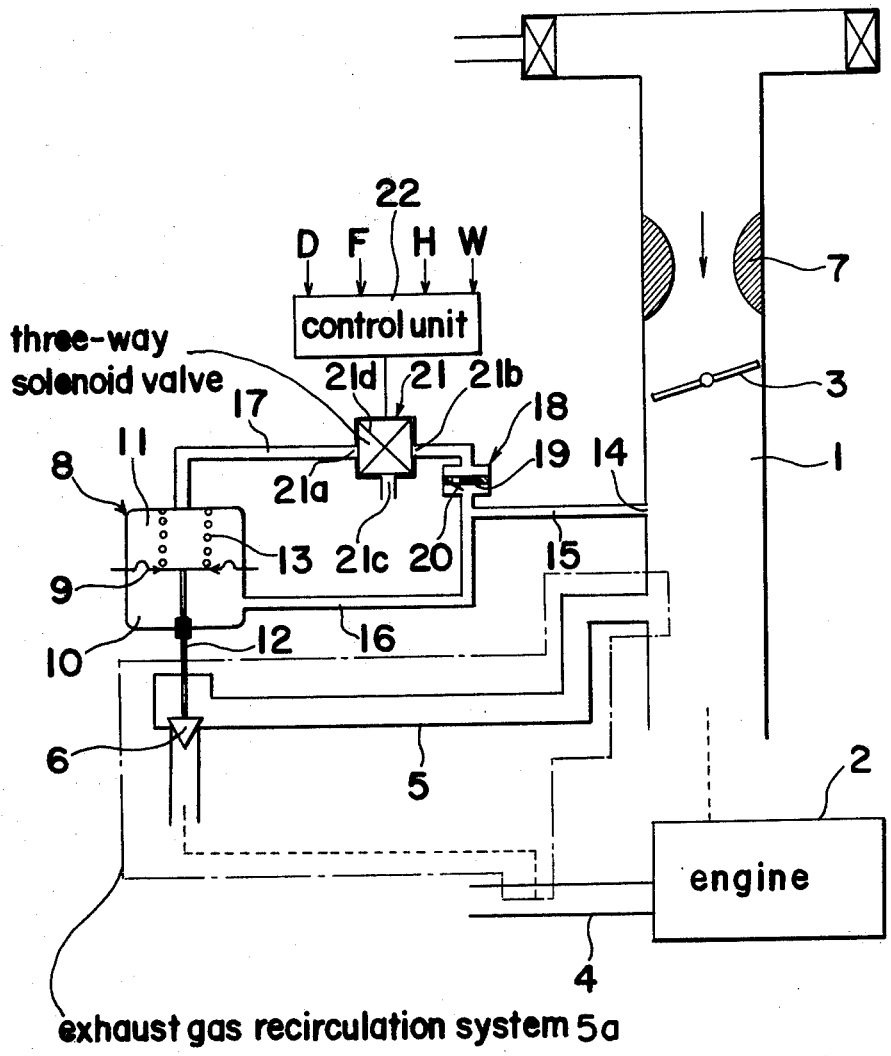
Figure 2:
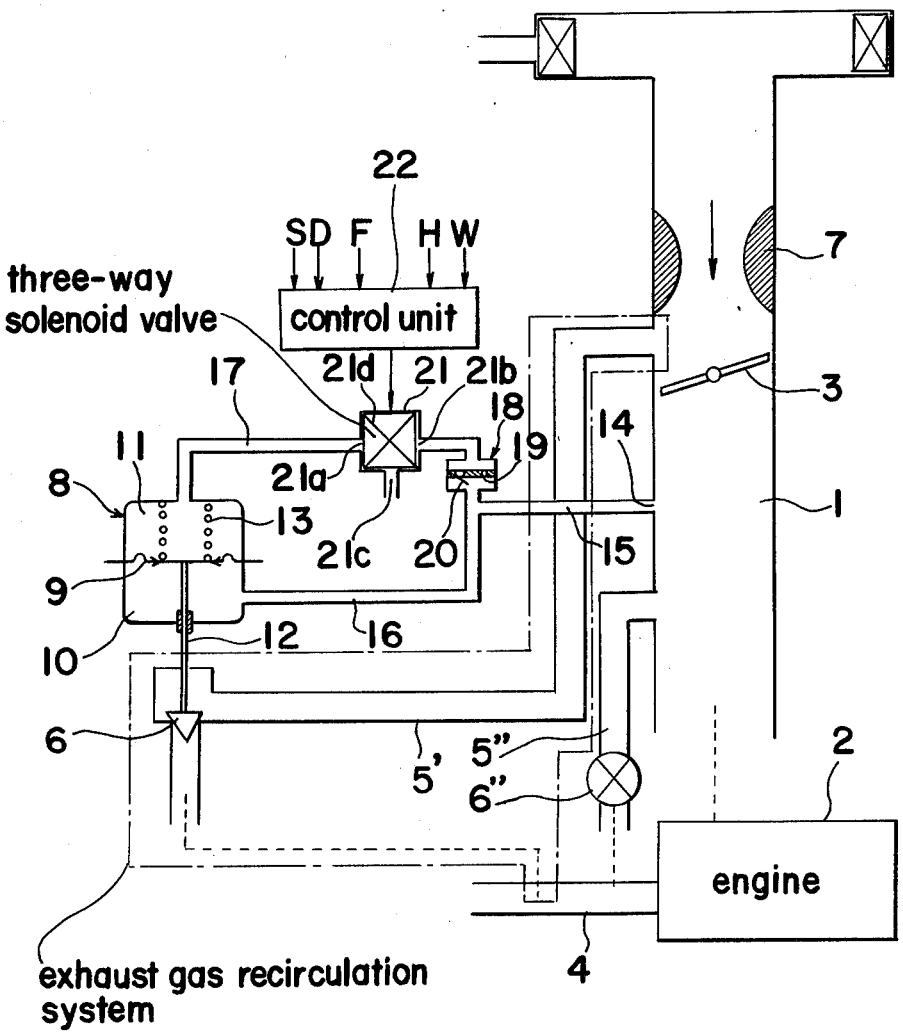

Referring to FIG. 2(*a*) there is shown an embodiment of the apparatus of the invention which is employed in a vehicle equipped with an exhaust gas recirculation system and in which the actuation rod 12 controls a valve 6, which controls, and may completely stop, flow of exhaust gas along an exhaust gas recirculation line 5 having one end connected to the exhaust pipe 4 of engine 2 and the opposite end opening into a portion of the intake horn 1 which is downstream of the throttle valve 3 and also of the pressure detection port 14. The valve 6 is held closed when the actuation rod 12 is in the normal position, and is opened to permit recirculation of exhaust gas when the diaphragm 9 is moved counter to the force of the spring means 13, which happens during normal acceleration, as described above. The control unit 22 may be actuated to render the acceleration detection means inoperative in response to one or several input signals supplied thereto. Examples of such input signals are the signals F, H and W, indicated schematically in the drawing. Signal F indicates that the throttle valve 3 is fully open, and is supplied by means for measurement of pressure downstream of the throttle valve 3 or means for mechanical detection of the throttle valve position, for example. Signal H is a signal indicating that the engine rotating speed is higher than a certain set speed, and may be supplied by a known rotameter means. Signal W indicates that the engine 2 is warming up, and is supplied by means which detects when the engine cooling water or oil is below a certain set temperature.

Even in normal running conditions, after warm-up of the engine 2, it is undesirable to effect recirculation of exhaust gas during acceleration if the acceleration is effected immediately after deceleration, since during deceleration pressure is lowered to a considerable degree in all portions of the second chamber 11 of the diaphragm unit 8 and second branch transmission line 17, and acceleration effected in these conditions results in sudden opening of the valve 6 and recirculation of a large amount of exhaust gas immediately at the start of acceleration, which is bad for the engine operation. To avoid this, the control unit 22 may also receive an input signal D causing it to actuate the abovementioned three-way solenoid valve 21*d*. Since it is very complicated to provide a means for detecting when acceleration immediately follows deceleration, signal D is suitably supplied by means which detects deceleration of the vehicle.

When the solenoid valve 21*d* of atmosphere connection unit 21 is actuated to open the atmosphere connection opening 21*c*, it may simultaneously close the delay element connection opening 21*b*. If the control unit 22 receives signal D as input, it is desirable that the opening 21*b* be closed when connection to the atmosphere is established through the opening 21*c*, since signal D is produced during deceleration of the vehicle, i.e., when there is a considerable degree of vacuum at the port 14. For signals F, H and W, however, closure of the connection opening 21*b* when the connection opening 21*c* is opened is not essential, since these signals are produced when the vehicle is accelerating and there is therefore comparatively high pressure at the port 14.

FIG. 2(*b*) illustrates employment of the another apparatus of the invention to control recirculation of exhaust gas. In this embodiment, the valve 6' is constituted as shown in FIG. 2(*a*) and controls flow of exhaust gas along a recirculation line 5' which connects to the exhaust pipe 4 and leads exhaust gas to a point of the intake horn 1 which is intermediate venturi section 7 and throttle valve 3. The exhaust gas recirculation system includes another recirculation line 5'' which leads from exhaust pipe 4 to a point of intake horn 1 downstream of the throttle valve 3 and pressure detection port 14, and has provided thereon a separate, independently controllable stop valve 6. The stop valve 6'' may be constituted as the valve 6 as shown in FIG. 2(*a*) or may be operated by the engine operating condition. The stop valve 6' is actuated by a diaphragm unit 8 associated with a delay element 18 and an atmosphere connection means 21 including a three-way solenoid valve 21*d* which is operated by means of a control unit 22 including a device for detecting and generating a signal S relating to temperature of an air to be supplied in the intake horn 1 in addition to devices generating signals D, F, H and W. On the contrary, the stop valve 6'' in the recirculation line 5'' of this embodiment may control the flow of exhaust gas in accordance with the driving condition of engine whereby the recirculation of exhaust gas is completely stopped during the warming up condition of engine.

Figure 3:
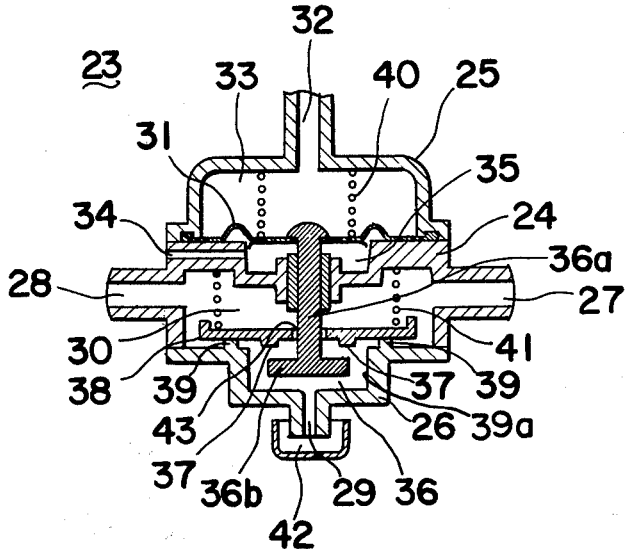
FIG. 3 is a cross-sectional view of an alternative means for connecting one chamber of a diaphragm unit employed in the apparatus of FIG. 2 to the atmosphere.

Referring is now had to FIG. 3, which shows a three-way solenoid valve 23 employed in another embodiment of the invention, and which renders the diaphragm unit 8 inoperative while the engine 2 is decelerating or the throttle valve 3 is fully open, but not while the engine 2 is running at medium speed. The valve 23 includes a main casing 24, whose bottom wall as seen in the drawing is constituted by a bottom cover 26, and to whose top wall is fixed a top cover 25.

A diaphragm 31 is provided in the space between the top cover 25 and main casing 24 and divides this space into a negative pressure chamber 33, which connects via a duct 32 to a point of intake horn 1 which is downstream of throttle valve 3, and an atmosphere chamber 35, which connects to the atmosphere via a duct 34 defined in a wall portion of the main casing 24. A first spring 40 provided in the negative pressure chamber 33 constantly urges the diaphragm 31 towards the atmosphere chamber 35.

The stem 36*a* of a first valve 36, which has one end fixedly attached to the diaphragm 31, extends downwardly through a slide bearing and seal means provided in the upper wall of main casing 24, and through a connection chamber 30 and opening 43 defined in a second valve 38 described below and is terminated by a valve head 36*b*, which is below second valve 38. The area of opening 43 is larger than the cross-sectional area of first valve stem 36*a* and smaller than the area of first valve head 36*b*.

The connection chamber 30 is defined between the main casing 24 and bottom cover 26, is in permanent connection with a line 27 which is formed in a side wall of the main housing 24 and leads to the delay element 18 and with a line 28 which is formed in the opposite side wall of main casing 24 and leads to the second chamber 11 of diaphragm unit 8, and may also connect to an atmosphere connection opening 29, which is formed in a bottom cover 26, and is provided with a suitable filter 42.

The inner surface of bottom cover 26 defines a well portion 39*a*, which, together with the atmosphere connection opening 29 may be separated from the remainder of chamber 30 and connection lines 27 and 28, by the above-mentioned second valve 38 in cooperation with the first valve 36. The second valve 38 has a generally plate-like construction, extends across the top of well portion 39*a*, and is normally urged into contact with a valve seat 39, defined by the upper surface portion of bottom cover 26, by a second spring 41 which is provided between the top of second valve 38 and the top wall of main casing 24. The lower surface of second valve 38 defines a valve seat 37 which may be contacted by the first valve head 36*b*.

Figure 4:
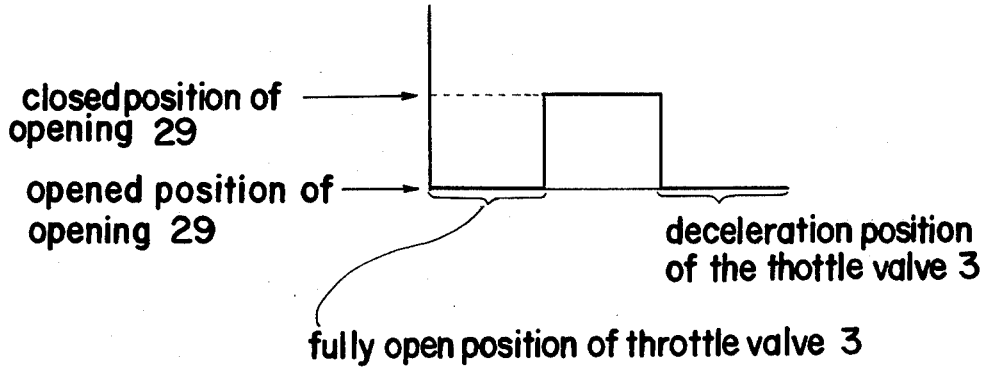
FIG. 4 is a graph showing conditions of acceleration detection means achieved by the apparatus of FIG. 3 for different engine operation conditions.

Referring to FIGS. 3 and 4, the three-way solenoid valve 23 functions as follows. When intake pressure downstream of the throttle valve 3 in the intake horn 1 is high i.e., when the throttle valve 3 is at or close to the fully open position, there is little difference between pressure in the negative pressure chamber 33 and atmosphere chamber 35, and the first spring 40 is therefore able to move the diaphragm 31 towards the atmosphere chamber 35, and cause the first valve 36 to be moved to a position in which the head 36*b* thereof does not contact the valve seat 37. At this time, therefore, the diaphragm unit 8 is rendered inoperative, since the opening 43 defined in the second valve 38 provides communication between the atmosphere connection opening 29 and line 28 leading to the second chamber 11 of diaphragm unit 8. With the first valve 36 in this position, the line 27 leading to the delay element 18 also is in communication with the atmosphere connection opening 29.

When the throttle valve 3 is closed a certain amount, in order to reduce speed, because of the increased vacuum downstream of the throttle valve 3 and consequent reduction of pressure in the negative pressure chamber 33, the pressure difference between the negative pressure chamber 33 and chamber 35 is sufficient to overcome the force of first spring 40 and move the diaphragm 31 to a position in which the first valve head 36*b* contacts the valve seat 37, so preventing communication between the atmosphere connection opening 29 and lines 28 and 29. The second chamber 11 of diaphragm unit 8 is therefore now connected to the delay element 18 by the line 28, connection chamber 30 and line 27, and the diaphragm unit 8 is actuated in the above-described manner when the engine 2 is accelerated.

This condition is maintained while the throttle valve 3 is closed a certain amount more, but when the throttle valve 3 has been brought near to the closed position, the degree of vacuum produced in the negative pressure chamber 33 is such that the pressure difference between the chamber 33 and atmosphere chamber 35 becomes sufficient to overcome the combined force of the first spring 40 and second spring 41 and to lift the second valve 38 off the valve seat 39, whereby, although the first valve head 36*b* is still in contact with the valve seat 37, communication is again established, between the atmosphere connection opening 29 and second chamber 11 of diaphragm unit 8, which is therefore rendered inoperative.

If it is considered undesirable to provide a communication between the atmosphere connection opening 29 and delay element 18 during this second stage of the valve 23 action, the second valve 38 may be provided with a peripheral portion which blocks the line 27 when the second valve 38 is raised from the valve seat 39.

Figure 5:
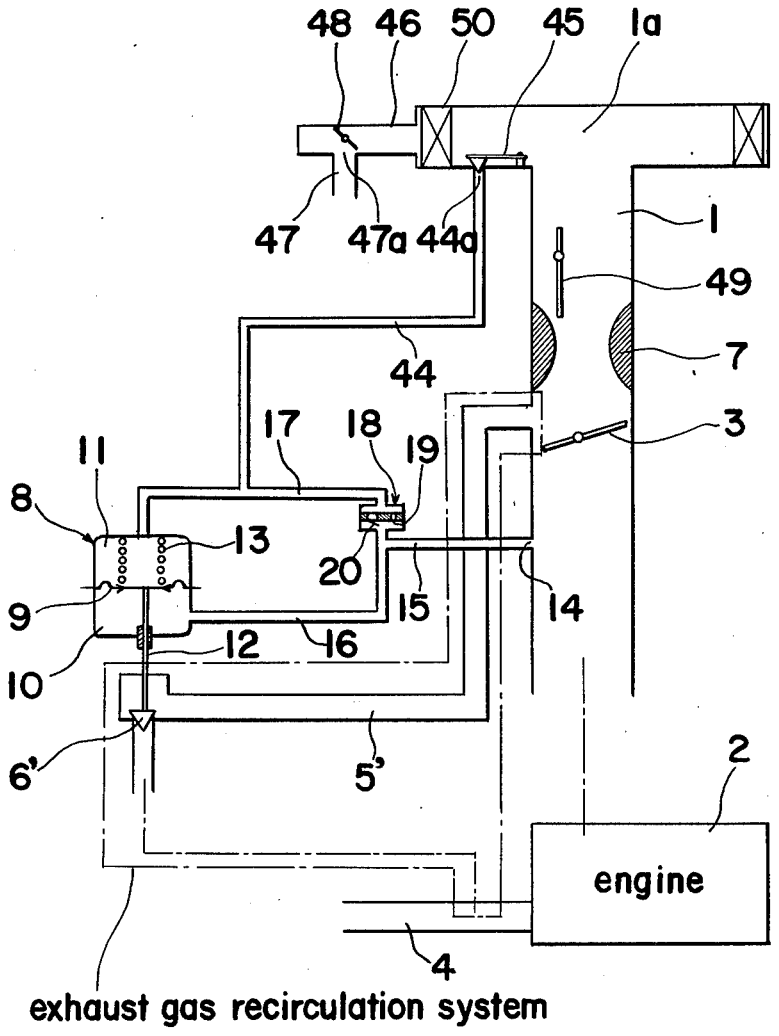
FIG. 5 is a schematic view showing an embodiment of the invention which is associated with an exhaust gas recirculation system and is actuated in response to carburetor intake air temperature.

FIG. 5 shows an acceleration detection means which is employed for control of the exhaust gas recirculation along the recirculation line 5' provided with the stop valve 6' as shown in FIG. 2(*b*) and which is rendered inoperative when temperature of air entering the intake horn 1 is lower a certain value. In this means, a duct 44 has one end opening into the second branch transmission line 17 and the other end 44*a* thereof opens into an intake portion 1*a* which is at the entry of intake horn 1 upstream of a choke valve 49. The other end 44*a* of the duct 44 may be opened into the intake horn 1 upstream of the valve 3, for example, adjacent to the venturi section 7. Air is supplied into the intake portion 1*a* directly from the atmosphere via a line 46 and/or from a source of air which has been heated by exhaust gas, for example, and is supplied along the duct 47 having an opening 47*a* which connects to the air supply line 46, and at which there is provided a valve 48 which is adjustable to control rate of flow of warm air into the air supply line 46 and normally maintain temperature of air supplied into the intake horn intake portion 1*a* at a suitable level. Before entering the intake portion 1*a* from the line 46 air passes through an air cleaner 50. At the opening 44*a* of duct 44 there is provided a stopper attached to a bimetallic temperature-sensitive element 45 which normally, i.e., when the temperature of intake air is above a certain set level, causes the stopper to close the opening 44*a*, whereby the diaphragm unit 8 is connected only downstream of the throttle valve 3 and functions in the abovedescribed manner. When however, the temperature of intake air falls below the set level bimetallic element 45 causes the stopper to open the duct 44, whereby the second chamber 11 of diaphragm unit 8 is connected to an air source which is at a pressure close to atmospheric pressure, the diaphragm unit 8 is rendered inoperative, and recirculation of exhaust gas in conditions in which freezing of moisture in the exhaust gas is liable to occur is avoided. The stopper may be operated not by the bimetallic temperature-sensitive element 45, but by electrical means or mechanical means responsive to temperature in the intake horn 1 upstream of the valve 3. Needless to say, the duct 44 may connect directly to the second chamber 11 of diaphragm unit 8, and the means of FIG. 5 may be employed independently or in combination with the means of FIG. 2.

In addition thereto, further changes and modifications are apparent to those skilled in the art upon reading of the description of the present invention with or without reference to the accompanying drawings. Therefore, these changes and modifications are to be construed as included within the true scope of the present invention unless they depart therefrom.

What is claimed is:

1. An apparatus for detection of acceleration of an engine of an automotive vehicle comprising a diaphragm unit including a displaceable diaphragm which divides said unit into a first chamber which is connected directly to a pressure detection port located downstream of a throttle valve in a carburetor of said engine and a second chamber which is connected to said pressure detection port through a delay element comprising a restriction orifice and a check valve which is disposed in parallel to said restriction orifice and opens when pressure in said second chamber is higher than, and closes when pressure in said second chamber is lower than pressure at said pressure detection port, said diaphragm being displaced to different positions in accordance with difference between pressure in said first chamber and pressure in said second chamber, an actuation rod element which is connected to and moved to different positions in accordance with movement of said diaphragm, said actuation rod element controlling actuation of regulation means for adjustment of factors relating to operation of said engine, a normally closed atmosphere connection means which may be opened to connect said second chamber of said diaphragm unit to an air source which is at or close to atmospheric pressure; and control means receiving input indicative of operating conditions of said engine and causing said atmosphere connection means to open in particular said conditions.

2. Acceleration detection apparatus as claimed in claim 1, wherein said regulation means includes an exhaust gas recirculation line having one end connected to an exhaust pipe of the engine and the opposite end opening into a portion of an intake passage of the engine, and valve means provided on said exhaust gas recirculation line for controlling recirculated exhaust gas.

3. Acceleration detection apparatus as claimed in claim 2, wherein said control means causes said atmosphere connection means to open when said engine is operated with said throttle valve at or close to the fully open position.

4. Acceleration detection apparatus as claimed in claim 2, wherein said control means causes said atmosphere connection means to open when said engine is being decelerated.

5. Acceleration detection apparatus as claimed in claim 2, wherein said control means causes said atmosphere connection means to open when said engine is operating a high rotary speed and said vehicle is running at high speed.

6. Acceleration detection apparatus as claimed in claim 2, wherein said control means causes said atmosphere connection means to open when said engine is being warmed up.

7. Acceleration detection apparatus as claimed in claim 2, wherein said opposite end of the exhaust gas recirculation line is opened into a portion of the intake passage which is upstream of the throttle valve.

8. Acceleration detection apparatus as claimed in claim 7, wherein said control means causes said atmosphere connection means to open when temperature of air entering said carburetor is below a set value.

9. Acceleration detection apparatus as claimed in claim 8, wherein said atmosphere connection means is constituted by duct means defining an inlet opening which opens into an air intake portion of said carburetor and leading to said second chamber of said diaphragm unit, and said control means comprises stopper means which may close said inlet opening and temperature detection and stopper positioning means which detects temperature of air in said carburetor intake portion, normally holds said stopper means in a position to close said inlet opening, and moves said stopper means out of contact with said inlet opening when temperature of air in said intake portion is below a certain level.

10. Acceleration detection apparatus as claimed in claim 1, wherein said atmosphere connection means includes a housing having at least a first connection port which is connected to an atmosphere source and a second connection port which is connected to said second chamber of said diaphragm unit and accommodating a solenoid valve means which normally closes said first connection port, and is movable to open said first connection port by said control means.

11. Acceleration detection apparatus as claimed in claim 1, wherein said atmosphere connection means comprises a casing defining a connection chamber, a first port via which said connection chamber is connected to said delay element, a second port via which said connection chamber is connected to said second chamber of said diaphragm unit, and a well portion which has an opening adjacent to said connection chamber and an end portion which is removed from said connection chamber and in which there is defined a third port which is connected to an atmosphere source, and said control means comprises wall portions external to said casing and defining a negative pressure chamber which is connected to a portion of said carburetor which is downstream of said throttle valve and an atmosphere chamber which is intermediate said negative pressure chamber and said connection chamber, a displaceable diaphragm element provided between and constituting the dividing wall between said negative pressure chamber and said atmosphere chamber, first spring means which is provided in said negative pressure chamber, constantly urges said diaphragm element towards said atmosphere chamber, and holds said diaphragm element in a normal position when there is generally equal pressure in said negative pressure chamber and said atmosphere chamber, second valve means which is provided in said connection chamber, is adjacent to and extends over an area which is at least equal to area of said well opening of said well portion, and defines a generally central communication opening, second spring means constantly urging said second valve means into a position in which peripheral portions thereof contact and provide an airtight seal at peripheral portions of said well opening, and a first valve means which has one end attached to and is displaced in accordance with displacement of said diaphragm element, and extends through a wall portion of said casing, through said connection chamber, and through said communication opening defined in said second valve means, the opposite end of which defines a valve head portion large enough to seal said communication opening, and which has a length such that said valve head portion thereof is out of contact with said second valve means when said diaphragm element is held in said normal position, and is brought into contact with said second valve means and seals said communication opening when said diaphragm element is displaced a certain amount due to lowering of pressure in said negative pressure chamber to a level below that of pressure in said atmosphere chamber.

* * * * *